US005236606A

United States Patent [19]

Rangel

[11] Patent Number: 5,236,606

[45] Date of Patent: Aug. 17, 1993

[54] PROCESS FOR OBTAINING AND MANUFACTURING LUBRICANT GREASES FROM FUMED SILICA AND PRECIPITATED SILICIC ACID

[76] Inventor: Victor D. L. Rangel, Zempoala #617, Col., Narvarte, Mexico, 03650

[21] Appl. No.: 814,769

[22] Filed: Dec. 30, 1991

[51] Int. Cl.[5] ..... C10M 113/12

[52] U.S. Cl. ..... 252/28; 252/21

[58] Field of Search ..... 252/28, 21

[56] References Cited

U.S. PATENT DOCUMENTS

| | | | |
|---|---|---|---|
| 3,770,633 | 11/1973 | Holley et al. | 252/28 |
| 4,378,297 | 3/1983 | Shin | 252/28 |
| 4,605,563 | 8/1986 | Heine et al. | 252/28 |
| 4,701,272 | 10/1987 | Mori et al. | 252/28 |
| 4,810,395 | 3/1989 | Levy et al. | 252/56 R |

*Primary Examiner*—Ellen McAvoy
*Attorney, Agent, or Firm*—Ladas & Parry

[57] ABSTRACT

A process to manufacture in laboratory and/or industrial scale lubricant greases using hydrophilic or hydrophobic silicon bioxide (fumed silica with a surface area in the range of 120 to 300 $m^2/g$), or ground precipitated silicic acid which is mixed and dispersed in an adequate and proportional manner with liquid or solid additives and with either pure paraffinic or naphthenic, heavy or light, refined or regenerated, mineral oils derived from petroleum to obtain mineral lubricant greases, or with treated vegetable oils, such as castor oil and soy oil, or synthetic esters like polyol esters and diesters or glycerine or propylene glycol, in order to obtain synthetic type lubricant greases, or with dimethyl and phenylmethyl polysiloxanes in order to obtain silicon greases. The lubricant greases of this invention may be applied with great advantages in the automotive and food industries, as well as industry in general, due to their special characteristics and properties of lubrication, purity and resistance to high or low temperatures, to water and to some solvents.

15 Claims, No Drawings

PROCESS FOR OBTAINING AND MANUFACTURING LUBRICANT GREASES FROM FUMED SILICA AND PRECIPITATED SILICIC ACID

BACKGROUND OF THE INVENTION

The present invention relates to a process to manufacture, in laboratory and/or industrial scale, mineral or synthetic or silicon lubricant greases, in which hydrophilic or hydrophobic silicon bioxide (fume silica) or precipitated and ground silicic acid are mixed with mineral oils or vegetable oils or synthetic esters or silicon oils or glycerine or propylene glycol at relatively low temperatures and pressures, including atmospheric pressures. As a result the control of the mixture as well as the control of the thickening or polymerization reaction are facilitated. The polymerization or thickening reaction may be carried out in a short time, in contrast to the process known up to now for the manufacture of metallic soap lubricant greases such as sodium, calcium, lithium, magnesium, aluminum and polyureas, in which the saponification of polymerization reaction is carried out at high pressures and temperatures in a considerably greater time, involving high manufacturing costs.

In the previous art, there are some processes that use silicon bioxide as a thickener, such as the process described in U.S. Pat. No. 4,378,297, in which lubricant sealers which are resistant to solvents such as chloroform and carbon disulfide are prepared by forming a ethylene glycol and a minor amount of water.

U.S. Pat. No. 4,701,272 discloses a silicon grease composition containing methylphenyl polysiloxane having a specific phenyl content hydrophilic fumed silica having a specific surface area of at least 130 $m^2/g$, and an alkoxy containing organosiloxane compound. Likewise, South African Patent No. 86/0555 discloses a grease containing a suitable polypropylene glycol, a thickener comprising finely particulate silicon and an extreme pressure functional additive.

However, the greases obtained from these mentioned processes have limited characteristics.

SUMMARY OF THE INVENTION

A principal object of this invention is to provide a process to manufacture, in laboratory and industrial scale, automotive and industrial lubricant grease by mixing hydrophilic or hydrophobic silicon bioxide (fumed silica) or precipitated silicic acid with solid or liquid additives and mineral oils derived from petroleum (paraffinic or naphthenic, refined or regenerated) or vegetable oils or synthetic esters, heavy glycols, silicon oils, glycerine or polypropylene glycol.

A further object of this invention is to provide lubricant greases that may be applied with great advantages in the food and automotive industries and in industry in general.

Another object of this invention is to provide lubricant greases that include special characteristics of lubrication, purity, resistance to high and low temperatures, to water and to some solvents.

An additional object of this invention is to obtain lubricant greases via a simple and exonomic process that is carried out at lower temperatures and pressures in contrast to the processes of the prior art.

The lubricant greases obtained have a buttery and homogenous texture, are easily applied manually or pneumatically, with hardnesses of types 6, 5, 4, 3, 2, 1, 0, 00 and 000 in accordance with the standard of the NLGI grade given in the formulation of the corresponding final product.

These and other objects of the present invention will become obvious from a study of the following specification and claims.

DETAILED DESCRIPTION OF THE INVENTION

In accordance with the present invention, there are now provided mineral or vegetable or synthetic or silicon lubricant greases prepared and obtained from several products used as raw material which are reacted chemically to give a final product that is a polymer having the characteristics and applications given by the formulation of these lubricant greases.

In general all liquids have different polarity or combination capacity, and therefore are classified in three large groups: high, medium and low polarity. In the case of this process, mineral oils in general, pure, heavy or light refined or regenerated, have a low polarity, and synthetic esters, polyol esters (pentaerythritol tetraester, pentaerythritol tetrapelargonate, trimethylol-propane-tripelargonate) and diesters (di-iso-decilester, di-2-ethyl-hexyl-adipate, di-iso-octyl-acelate) which have a high molecular weight of between 370–600, the high weight polyesters, and silicon oils (dimethyl and phenylmethyl polysiloxanes) have medium polarity. Thus to prepare and manufacture the lubricant greases of this invention, the "basic oils" or "synthetic esters" (polyol esters and diesters) "silicon oils" (dimethyl and phenylmethyl polysiloxanes) above mentioned are mixed and reacted with a polar agent.

The process of the present invention for preparing and manufacturing lubricant greases comprises the steps of contacting a basic oil selected in accordance with the type and the desired properties of the final product, and from the group consisting of a mineral or vegetable oil, a synthetic ester (polyol esters and diesters), silicon oils (dimethyl and phenylmethyl polysiloxanes), glycerine and polypropylene glycol, with a polar agent such as ethylene glycol or another similar polar compound in a reaction vessel or reactor at a pressure ranging from about 760 to 586 mm of Hg depending on the altitude of the work place or the reaction equipment, and at a temperature in the range from 25 to 80 oC, which can be reached by steam or some other heating means, and under constant stirring in order that the "basic oil" be mixed and completely dispersed and be ready to receive a "package of additives" previously selected to give to the final product or lubricant grease, characteristics such an anti-oxidant, anti-rust, characteristics of extreme pressure (EP), resistance to water and to high and low temperatures, resistance to some solvents and other properties depending on the desired use.

The amount of the polar agent used ranges from about 1 to about 5% by weight of the total composition.

Once the mixture has been completely homogenized and the temperature has been controlled, the hydrophilic or hydrophobic silicon bioxide (fumed silica with a surface area of between 120–300 m/g) or precipitated silicic acid is added by manual or pneumatic discharge to be uniformly mixed with the selected "basic oil" and with the group or "package of selected additives". The polymerization or thickening reaction is carried out to obtain a uniform mass without lumps and with a buttery shiny appearance. However, air may remain trapped or the stirring may not give a homogeneous product and the appearance may be lumpy. In that case, the mass of lubricant grease can be passed through a colloidal mill with the purpose of grinding it to de-aerate and homogenize it. The grease thus obtained, is ready to be checked for the final hardness that was obtained, which is generally in accordance with the formulation developed.

It is advisable to clarify that lubricant greases are classified according to their hardness with the grades "000", "00", "0", "1", "2", "3", "4", "5", "6", according to the universal standard of the Lubricating Grease Institute (NGLI). Therefore in order to obtain a particular hardness grade or type, the viscosity of the "basic oil", either mineral, vegetable, synthetic (polyol esters and diesters) or silicon (dimethyl and phenylmethyl polysiloxanes, will be selected or adjusted by adding the polar agent and the thickening agent, in this case, the hydrophilic or hydrophobic fumed silica or precipitated and ground silicic acid, to obtain the lubricant grease with the desired hardness degree.

In light of the above, a product or mass will be obtained, in this case of mineral or vegetable or synthetic or silicon "lubricant grease" with the lubricating characteristics given by: the package or a set of liquid or solid additives, previously selected and quantified in a range of 1 to 15%, the basic oil and the amount of hydrophilic or hydrophobic fumed silica, and the amount of precipitated and ground silicic acid, which can range from about 3 to about 15% to obtain likewise the desired hardness degree.

The reactor or reaction equipment use din this process may be equipped with a heating and/or cooling system and stirring equipment, preferably high speed stirrers, closed or open to work at pressures ranging from about 760 to 580 mm of Hg, and at a temperature between 30 and 80° C., which can be reached by heating with steam or other conventional heating means.

I claim:

1. In a process for making a lubricant grease, wherein a basic oil is mixed with silica, a polar compound, and an additive or additives to impart desired characteristics to the crease, the improvement comprising selecting the basic oil from the group consisting or mineral oils, polyol esters, and silicon oils, mixing said basic oil with said polar agent in a vessel under constant stirring at a temperature and pressure sufficient to obtain a homogenous mixture, and then and only then reacting said homogenous mixture with an additive or additives and a thickening agent selected from the group consisting of fused silica and silicic acid.

2. An improved process to obtain lubricant greases of claim 1, wherein the mixing is carried out at a temperature between 30 and 80° c., and at a pressure ranging from about 585 to about 760 mm of Hg.

3. An improved process to obtain and manufacture lubricant greases of claim 1, wherein the basic oil is a mineral oil.

4. An improved process or procedure to manufacture lubricant greases of claim 1, wherein the basic oil is a polyol ester selected from the group consisting of pentaerythritol tetraester, pentaerythritol-tetrapelargonate and trimethylolpropane tripelargonate.

5. An improved process to manufacture lubricant greases of claim 1, wherein the basic oil is a diester selected from the group consisting of di-iso-decyl-ester, di-2-ethylhexyl-adipate and di-iso-octyl-acelate.

6. An improved process to manufacture lubricant greases of claim 1, wherein the polar agent is ethylenegylcol.

7. An improved process to manufacture lubricant greases of claim 1, wherein the polar agent is used in a percentage of from about 1 to 5% by weight of the lubricant grease.

8. An improved process to manufacture lubricant greases of claim 1, wherein the additive or additives impart to the lubricant grease resistance to oxidation, corrosion, extreme pressure and water.

9. An improved process to manufacture lubricant greases of claim 1, wherein the mixing and reacting steps result in a lubricant grease having air bubbles, and wherein the process further comprises grinding the lubricant grease substantially to remove the air bubbles.

10. An improved process to manufacture lubricant greases of claim 1, wherein the thickening agent is fumed silica having a surface area of between 120 and 300 m/g.

11. An improved process to manufacture lubricant greases of claim 1, wherein the reaction is carried out in a reactor which has a cooling and/or heating system.

12. An improved process to manufacture lubricant greases of claim 1, wherein the basic oil is a silicon oil selected from the group consisting of dimethyl polysiloxane and phenyldimethyl polysiloxane.

13. An improved process to manufacture lubricant greases of claim 1, wherein the thickening agent is silicic acid which is added in an amount ranging from about 3 to 15% by weight of the lubricant grease.

14. A grease obtained by the process of claim 1.

15. A process as claimed in claim 1, wherein the basic oil is a silicon oil and said homogenous mixture consists essentially of said silicon oil, said polar compound, and said additive or additives.

* * * * *

UNITED STATES PATENT AND TRADEMARK OFFICE

CERTIFICATE OF CORRECTION

PATENT NO. : 5,236,606

DATED : August 17, 1993

INVENTOR(S) : Victor D. Lopez Rangel

It is certified that error appears in the above-indentified patent and that said Letters Patent is hereby corrected as shown below:

Title page at "[76] Inventor:"

change "Victor D.L. RANGEL to -- Victor D. Lopez Rangel--

Column 1, line 63 change "exonomic" to -- economic--

Column 2, line 24 change "di-iso-decilesster" to di-iso-decylester--

Column 2, line 62 change "m/g" to -- $m^2/g$--

Column 3, line 13 change "(NGLI)" to --(NLGI)--

Column 3, line 33 change "use din" to -- used in--

Column 3, line 45 change "crease" to -- grease--

Column 3, line 53 change "fused" to -- fumed--

UNITED STATES PATENT AND TRADEMARK OFFICE

CERTIFICATE OF CORRECTION

PATENT NO. : 5,236,606

DATED : August 17, 1993

INVENTOR(S) : Victor D. Lopez Rangel

It is certified that error appears in the above-indentified patent and that said Letters Patent is hereby corrected as shown below:

Column 4, line 36 change "m/g" to -- $m^2/g$--

Signed and Sealed this

Eighteenth Day of April, 1995

Bruce Lehman

*Attest:*

BRUCE LEHMAN

*Commissioner of Patents and Trademarks*

*Attesting Officer*